US005155979A

United States Patent [19]

McDonald

[11] Patent Number: 5,155,979

[45] Date of Patent: Oct. 20, 1992

[54] PACKAGING METHOD AND APPARATUS

[75] Inventor: Ian W. McDonald, Wells, England

[73] Assignee: Food Machinery Design Limited, Somerset, England

[21] Appl. No.: 740,094

[22] Filed: Aug. 5, 1991

[30] Foreign Application Priority Data

Aug. 7, 1990 [GB] United Kingdom ..... 9017288
Jan. 23, 1991 [GB] United Kingdom ..... 9101488
May 7, 1991 [GB] United Kingdom ..... 9109764

[51] Int. Cl.[5] ..... B65B 9/06; B65B 51/30

[52] U.S. Cl. ..... 53/550; 53/450; 53/202

[58] Field of Search ..... 53/450, 451, 550, 551, 53/553, 554, 546, 202

[56] References Cited

U.S. PATENT DOCUMENTS 2,139,039 12/1938 Salfisberg ..... 53/546 X
2,401,110 5/1946 Rohdin ..... 53/546 X
2,565,444 8/1951 Waters ..... 53/550 X
2,978,853 4/1961 Price ..... 53/546
3,009,298 11/1961 Gerlach et al. ..... 53/550 X
3,377,773 4/1968 Clark ..... 53/546
3,581,457 6/1971 Gerlach et al. ..... 53/546 X
3,760,559 9/1973 Heinzer ..... 53/546
4,035,984 7/1977 Gerlach et al. ..... 53/550 X
4,256,256 3/1981 Meyers ..... 53/550 X
4,288,967 9/1981 Seko et al. ..... 53/550
5,050,368 9/1991 Noh ..... 53/450 X

FOREIGN PATENT DOCUMENTS 1332242 10/1973 United Kingdom .
1578973 11/1980 United Kingdom .
2088811 6/1982 United Kingdom .

*Primary Examiner*—Horace M. Culver
*Attorney, Agent, or Firm*—Bacon & Thomas

[57] ABSTRACT

Form-fill-seal apparatus for simultaneously packaging two streams of articles (15), a sheet of packaging material (17) being brought around the adjacent articles (15), a central portion of the material (17) being passed between the streams of articles (15) and between outer edge portions of the packaging material (17). The packaging material (17) is sealed through the combined thicknesses of its central portion and its edge portions without introducing a sealing device between the articles (15). Adjacent packages can be separated by cutting through the central portion of the packaging material (17), for example using a blade (29) positioned along the line of flow of the articles (15). The present invention enables hitherto proposed single stream form-fill-seal apparatus to be modified relatively easily to enable twin streams of packages to be produced without increasing the speed of the packaging material or the linear speed of individual articles.

8 Claims, 2 Drawing Sheets

FIG. 1.
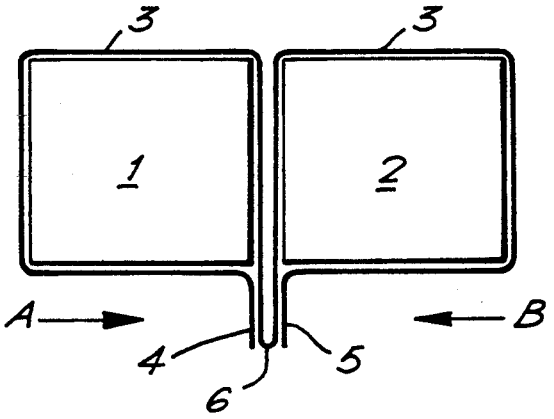
FIG. 2.
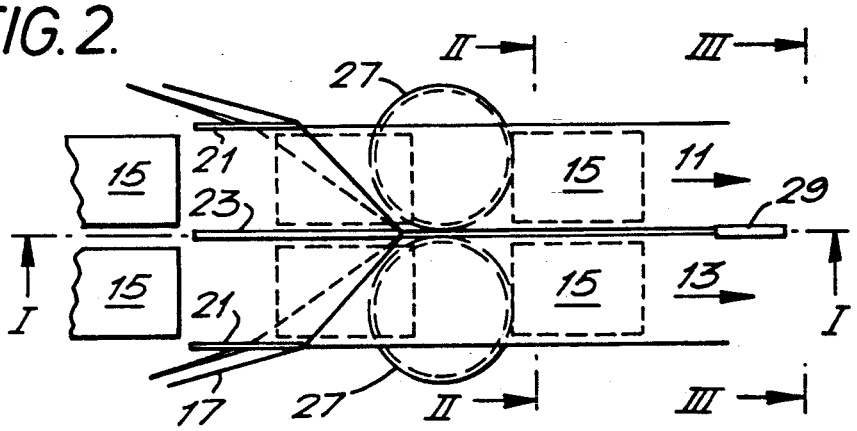
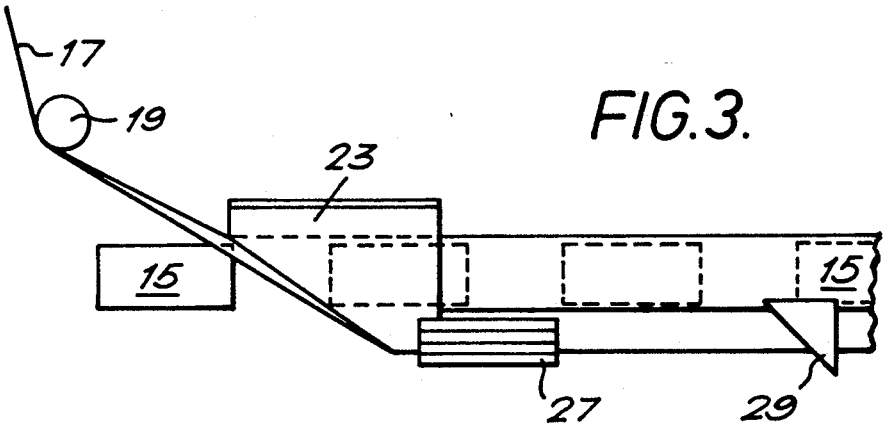
FIG. 3.

PACKAGING METHOD AND APPARATUS

This invention concerns methods of and apparatus for the form-fill-seal packaging of articles.

Form-fill-seal apparatus is widely used for packaging articles, a flat sheet of packaging material being formed and sealed around the articles to produce a package around the articles. Hitherto proposed form-fill-seal apparatus effects packaging with the articles moving in a single vertical or horizontal stream, a single sheet of the packaging material being fed from a roll and sealed around the stream of articles to form a single stream of packages.

The quest for ever faster packaging speeds has resulted in improvements in the design of form-fill-seal apparatus which enable them to function more rapidly, but this is usually achieved at greater capital cost. Furthermore, although the apparatus can be designed to run at faster linear speeds, and thereby package more articles in a given time, there is a limit to the linear speed at which such packaging apparatus can be used as the effectiveness of the seals of the resulting packages tends to be reduced as the speed of their formation is increased.

As an alternative to increasing the linear speed of the articles, it has also been proposed to use a number of form-fill-seal stations in parallel, each station receiving a single stream of articles. Although this can result in the production of a larger number of packages in a given time than with apparatus processing a single stream of articles, the capital cost of such apparatus is high, and the running costs are also high, especially if some of the stations are not used.

According to the present invention there is provided form-fill-seal apparatus comprising article supply means for supplying at least two adjacent streams of articles to be packaged by the apparatus, packaging material supply means for providing a supply of packaging material in which the articles are to be packaged, and packaging material forming and sealing means for forming and sealing the packaging material around the articles to form at least two adjacent streams of packages, the sealing means being such that the package seals formed in the direction of flow of the said streams of articles are formed for adjacent streams by sealing through the combined thicknesses of the packaging material forming the seals of the said adjacent streams and are formed in a plane substantially perpendicular to the plane along which the adjacent streams of articles flow.

The invention further provides a method of form-fill-seal packaging of articles comprising providing at least two adjacent streams of articles to be packaged by the apparatus, supplying packaging material in which the articles are to be packaged, and forming and sealing the packaging material around the articles to form at least two adjacent streams of packages, the package seals considered in the direction of flow of the said streams of articles being formed for adjacent streams by sealing through the combined thicknesses of the packaging material forming the seals of the said adjacent streams and in a plane substantially perpendicular to the plane along which the adjacent streams of articles flow.

The present invention enables the numbers of packages produced to be at least doubled compared with form-fill-seal apparatus having a single stream of articles, and without increasing the linear speed at which the packaging material is supplied to the apparatus. In particular, this can avoid the problems resulting from feeding articles or packaging materials at higher linear speeds necessary hitherto to increase packaging speeds. Thus problems with inadequate sealing caused by increased packaging linear speeds in hitherto proposed apparatus can be avoided.

The packaging material supply means preferably supplies a single sheet of packaging material which is brought around the said at least two adjacent streams of articles to form at least two adjacent streams of packages.

Forming of the packaging material around the articles is preferably effected by guide means which guides a central loop portion of a single sheet of packaging material between adjacent streams of articles so that guided packaging material is brought between opposite edge portions of the single sheet, advantageously so that the inner surfaces of the loop are also brought together prior to the point of sealing.

It is generally preferred to use a single sheet of packaging material to form the adjacent streams of packages, but it will be appreciated that separate sheets can be used to package adjacent streams. Thus, instead of supplying a single sheet of packaging material, the packaging material supply means can supply a plurality of sheets of packaging material, the packaging material forming and sealing means then enabling one of said plurality of sheets to be formed around one stream of the articles and another of said plurality of sheets to be formed around an adjacent stream of articles, adjacent edge portions of the respective sheets being positioned so that sealing of packages in adjacent streams is effected through the combined thicknesses of the edge portions of at least two of the said sheets.

Slitter means for slitting the packaging material between the said adjacent packages in the adjacent streams will usually be provided when a single sheet of packaging material is formed around adjacent streams of articles. This can be positioned at various positions along the direction of flow of the articles. Such slitter means is not required where adjacent streams of articles are packaged in separate sheets of packaging material.

Sealing of the packages in the direction of the said streams is effected through the combined thicknesses of the packaging material around adjacent streams of articles. In the case of a single sheet of packaging material this will be through the said edge portions and the said central portion. Thus sealing is effected through at least four thicknesses of packaging material when two seals are formed simultaneously, and in general the number of thicknesses of packaging material through which seals are formed simultaneously will be double the number of seals being formed. The sealing means is advantageously arranged not to pass between adjacent articles in the adjacent streams during the formation of the seals which are formed in the direction of flow of the streams of articles, this providing a particularly convenient method of forming these seals.

The sealing means preferably comprises a pair of rollers which seal the packaging material in the direction of flow of the articles and simultaneously seal the packaging material around articles in adjacent streams of articles.

Various packaging materials can be used in accordance with the invention, for example polymeric films or paper. The packaging materials can be heat sealable, or they can be provided with an adhesive for effecting sealing of the packages, for example using a cold seal adhesive. In order to facilitate heat sealing of heat sealable packaging materials, the guide means can be heatable to preheat the packaging material before the seals are formed in the direction of flow of the articles, the heat sealing means then not being required to effect all of the heating necessary to form at least two heat seals simultaneously.

Although, in accordance with the present invention, more than two adjacent streams of articles can be packaged simultaneously, two streams do provide a doubling of packaging speed compared with hitherto proposed form-fill-seal apparatus with the packaging material supplied at the same linear speed.

The present invention will now be described, by way of example, with reference to the accompanying diagrammatic drawings in which:

FIG. 1 is a vertical section through two articles being packaged in accordance with the present invention, transverse to the article flow direction;

FIG. 2 is a plan view of a portion of an embodiment of apparatus in accordance with the present invention;

FIG. 3 is a vertical section on line I—I of FIG. 2;

Figure 4:
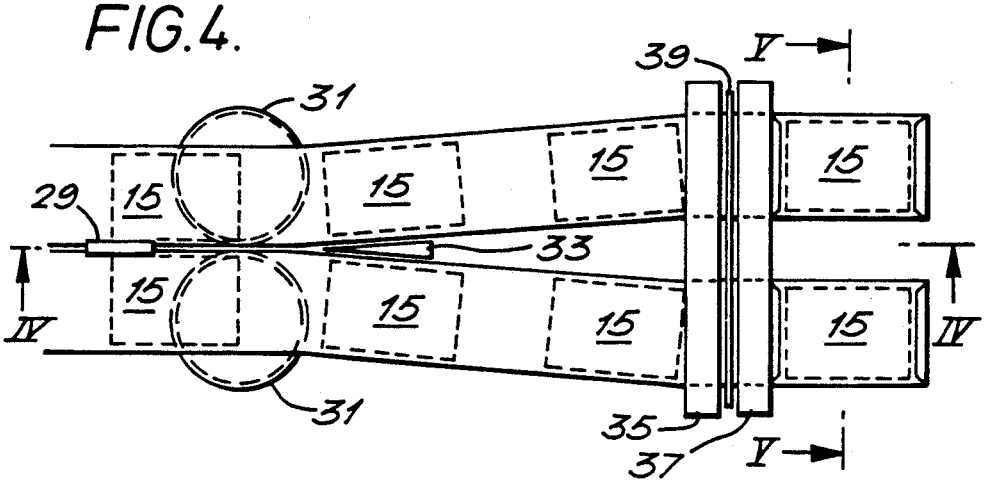
FIG. 4 is a plan view of a further portion of the embodiment of FIG. 2 considered in the direction of article flow.
Figure 5:
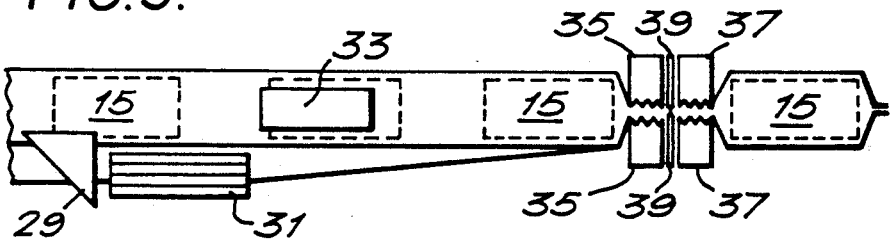
FIG. 5 is a vertical section on line IV—IV of FIG. 4.
Figure 6:
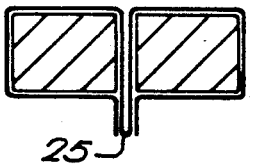
FIG. 6 is a vertical section on line II—II of FIG. 2.
Figure 7:
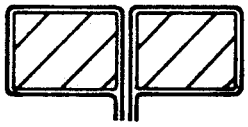
FIG. 7 is a vertical section on line III—III of FIG. 2.

Referring to FIG. 1 of the drawings, two articles to be packaged (1 and 2) are shown with a single sheet of a one side heat sealable polymeric film 3 disposed around them, the film 3 having been fed as a flat sheet from a roll (not shown), and with the heat sealable surface of the film 3 contacting the articles 1 and 2. The film 3 is brought into this position by loosely passing the film around the articles 1 and 2, and pushing a central loop 6 of the film 3 between the articles to the position shown in the drawing, thereby bringing the film 3 into close contact with the articles 1 and 2. As will be clear to those skilled in the art, this can be effected using suitably shaped guide members (not shown). Outer edge portions 4 and 5 of the film 3 abut the loop 6 with the heat sealable surfaces of the film in contact where they abut. Longitudinal heat seals are then formed between the respective contacting edge portions 4 and 5 of the film 3 and the loop 6 by applying heated jaws or rollers as indicated by the arrows A and B. The loop 6 does not seal to itself as the surface of the film contacting itself within the loop is not sealable to itself.

Transverse seals can be formed in known manner, and the packaged articles 1 and 2 can then be separated before or after transverse sealing by slitting the loop 6 along its length, for example using a suitable positioned cutter blade, e.g. a sloping blade or a rotating blade. This can be facilitated by moving the packaged articles apart so that the loop is lifted into engagement with the cutter blade.

As will be appreciated, the film 3 in FIG. 1 is only heat sealable between the face contacting the articles 1 and 2 and that same face. In particular it only forms the desired heat seal between the respective edge portions 4 and 5 and the loop 6, and it does not seal the abutting faces of the film 3 within the loop 6. Different relative dispositions of the edge portions 4 and 5 of the film 3 and the loop 6 can necessitate the film 3 having heat sealable layers on opposite faces, for example if the edge portions 4 and 5 extend upwardly around the articles 1 and 2, and between the respective articles and the loop 6. Heat seals can then be formed by applying heat to the film 3 within the loop 6 against the articles 1 and 2.

An embodiment of horizontal form fill seal apparatus in accordance with the invention will now be described with reference to FIGS. 2 to 6 of the accompanying drawings.

FIG. 2 is a cut away plan view of a conventional horizontal form fill machine modified in accordance with the invention. Instead of the conventional single stream of articles to be packaged in a packaging material when the apparatus is used in accordance with the prior art, the illustrated apparatus shows two parallel and adjacent streams 11 and 13 of articles 15. The streams of articles 15 are fed in conventional manner, but with a separator extending along the direction of flow of the articles (not shown) preventing adjacent articles from contacting each other.

One-side heat sealable packaging film 17 is fed in known manner with its heat sealable surface down from a reel (not shown) around a guide roller 19, over a folding box 21, and then around both streams of articles 15. Unlike prior art horizontal form fill seal packaging apparatus and methods, the film 17 is not brought tightly around the articles at this stage, but a central loop in the film 17 is guided downwardly by a guide plate 23 between the adjacent streams of articles 15 as shown in FIG. 3, and then tightly around the articles 15.

Opposite edge portions of the film 17 are brought together in known manner in preparation for heat sealing, but with the loop of film 6, 25 (FIGS. 1 and 6 respectively) extending between these edge portions.

The opposite edge portions of the film 17 with the loop 25 therebetween are then guided between a pair of guide rollers 27. The guide rollers 27 can be heated to effect heat sealing between respective edge portions of the film 17 and the external surface of the loop 25, but it is generally preferred to use a further pair of rollers 31 (FIGS. 4 and 5) down stream of rollers 27 to effect heat sealing, the rollers 27 then acting to give improved control of the film flow. The resulting seal is formed in a vertical plane.

In order to separate the two adjacent streams of articles 15, the film 17 is slit along its length by a cutter blade 29 extending through the loop 25. The blade 29 is shown in FIG. 3 following the rollers 27 in the direction of flow of the film 17. However it can be located at other positions along the direction of flow, for example before the rollers 27 or even after the further pair of rollers 31 referred to above. It is generally preferred to effect slitting after the rollers 27 in the interests of control of the film. However, the guide plate 23 can, if desired, incorporate the cutter blade 29 and thereby effect guiding and slitting in one operation.

It should also be appreciated that the edge portions of the film 17 could be brought together between a pair of guide rollers located before the guide plate 23, again in the interests of film control, and especially where the guide plate 23 incorporates the cutter blade 29.

Once the adjacent streams 11 and 13 of articles 15 have been sealed into the film 17 by the heat seal formed in the direction of flow of the articles 15, the two streams of articles in their respective tubes of film are moved apart by a flow separator 33. The film 17 is then heat sealed transversely using two pairs of heat seal jaws 35, 37, which act in a vertical plane to produce a seal in a horizontal plane. Thus the longitudinal and transverse seals of the packages formed by the apparatus are formed in mutually perpendicular planes.

A cutter blade 39 is used to cut the film 17 between the respective pairs of heat seal jaws 35, 37, to produce individual packages.

Although the transverse and longitudinal seals are formed in mutually perpendicular planes, moving the respective flows of articles apart before the transverse seals are formed enables the longitudinal seal to be brought into the plane in which the transverse seals are subsequently formed, thereby facilitating the formation of the transverse seals.

Figure 8:
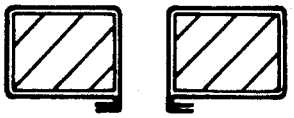
FIG. 8 is a vertical section on line V—V of FIG. 4.

The appearance of the packages can be enhanced by bringing the longitudinal seal 31 of each package under the articles, as shown in FIG. 8.

If the film 17 is heat shrinkable, it can then be heat shrunk on to the articles 15 after the packages have been sealed.

The number of adjacent articles need not be restricted to two. Seals between adjacent articles will then be formed not only by sealing edge portions of the film to a single loop of film passing between the streams of articles, but by additional loops of film into which the loops 6 extend.

Sealing of the packages can be effected other than by heat sealing, for example using a cold seal adhesive.

Although the present invention has been particularly described with reference to horizontal form-fill-sealing with the seals being formed below the articles, it will be appreciated that the invention can be used with horizontal form fill seal apparatus in which the seal is formed above the articles. In addition, it will be appreciated that the present invention can also be applied to vertical form fill seal apparatus.

If desired, apparatus of the present invention can include means for introducing a desired, e.g. a controlled, atmosphere into the packages before they are sealed, or of providing a reduced pressure within the packages.

The present invention is of particular value as it enables the speed of hitherto proposed form-fill-seal apparatus designed to package a single stream of articles to be at least doubled relatively easily without increasing the linear speed of the packaging material through the apparatus. Furthermore, this can be achieved by relatively simple modifications to such hitherto proposed apparatus.

As will be appreciated by those skilled in the art, the hereinbefore described embodiment can be modified in a variety of ways. For example, instead of a stationary cutter blade 29 cutting down through the packaging material, other types of knife can be used, e.g. a rotary knife, which can be located to cut the packaging material from substantially the same direction as the blade 29 or alternatively from the side to cut through the combined thicknesses of the longitudinal seals.

I claim:

1. Form-fill-seal apparatus comprising:

(a) article supply means for supplying two adjacent streams of articles to be packaged by the apparatus;

(b) packaging materials supply means for providing a supply of packaging material in which the articles are to be packaged;

(c) packaging material forming means for forming the packaging material around the articles in the two adjacent streams, the packaging forming means comprising (i) packaging material edge guide means for guiding edge portions of the packaging material around the said streams of articles; and (ii) packaging material forming means for forming a central portion of the packing material between the said edge portions in a plane substantially perpendicular to a plane in which the articles are moved through the apparatus;

(d) first sealing means for sealing the said edge portions of the packaging material to a central portion of the packaging material through the combined thicknesses of the said edge portions and of the said central portion, the first sealing means producing a longitudinal seal considered in the direction of flow of the streams of articles substantially perpendicular to the plane in which the said articles flow;

(e) guide means for guiding the streams of articles apart after the said longitudinal seals have been formed; and (f) second sealing means for forming transverse seals across the direction of flow of the streams of articles after the streams of articles have been guided apart, the said second sealing means acting to form the transverse seals in a plane substantially perpendicular to the plane in which the said longitudinal seals are formed.

2. Apparatus according to claim 1, wherein the packaging material supply means is adapted to supply a single sheet of packaging material and including means for bringing said sheet around the said at least two adjacent streams of articles to form at least two adjacent streams of packages.

3. Apparatus according to claim 1, including slitter means for flitting the packaging material between the said adjacent packages in the adjacent streams.

4. Apparatus according to claim 1, wherein the sealing means comprises a pair of rollers which seal the packaging material in the direction of flow of the articles and simultaneously seal the packaging material around articles in adjacent streams of articles.

5. Apparatus according to claim 1, wherein the first and second sealing means effect sealing by heat.

6. Apparatus according to claim 1, wherein the sealing means is adapted to form a cold seal.

7. Apparatus according to claim 1, including heat shrinker means for heat shrinking the packaging material around the articles after packaging.

8. Apparatus according to claim 1, wherein the machine is a horizontal form-fill-seal machine.

* * * * *